United States Patent [19]

Kuranishi et al.

[11] Patent Number: 4,603,987

[45] Date of Patent: Aug. 5, 1986

[54] RECORDING MEMBER PRESSING DEVICE IN A PRINTER

[75] Inventors: Masaaki Kuranishi; Susumu Nonaka, both of Yamatokoriyama; Koichi Furukawa, Kashihara; Fumio Siozaki, Tenri, all of Japan

[73] Assignee: Sharp Kabushiki Kaisha, Osaka, Japan

[21] Appl. No.: 703,595

[22] Filed: Feb. 20, 1985

[30] Foreign Application Priority Data

Feb. 20, 1984 [JP] Japan ..... 59-31009

[51] Int. Cl.[4] ..... B41J 13/036; B41J 13/20

[52] U.S. Cl. ..... 400/639.1; 400/708; 271/171

[58] Field of Search ..... 400/605, 708, 637, 639, 400/639.1, 639.2, 126; 355/14 SH; 271/171, 173

[56] References Cited

U.S. PATENT DOCUMENTS

| | | | |
|---|---|---|---|
| 3,311,371 | 3/1967 | Zeuthen | 271/240 |
| 3,647,207 | 3/1972 | McPherson | 271/171 |
| 4,231,566 | 11/1980 | Suzuki | 271/171 |
| 4,285,507 | 8/1981 | Marinoff | 400/126 |
| 4,468,113 | 8/1984 | Motohashi et al. | 355/14 SH |

FOREIGN PATENT DOCUMENTS

| | | | |
|---|---|---|---|
| 126470 | 9/1980 | Japan | 400/639.1 |
| 151385 | 9/1982 | Japan | 400/639.1 |
| 165280 | 10/1982 | Japan | 400/605 |

*Primary Examiner*—William Pieprz

*Attorney, Agent, or Firm*—Birch, Stewart, Kolasch and Birch

[57] ABSTRACT

In a printer including a platen rotatably provided around a first axis and a plurality of recording member pressing rollers rotatably provided around a second axis parallel with the first axis in which a recording member is forwarded to a printing position around the platen faced with a printing head and is pressed on the platen by the recording member pressing rollers, a recording member pressing device comprises a memory for storing positioning information of at least one of the pressing rollers depending on the size of the recording member, a recording member size detector for detecting the size of the inputted recording member, read-out means responsive to the recording member size detector for reading out the positioning information stored in the memory, and positioning means responsive to the read-out means for slidably moving the at least one of the pressing rollers along the second axis and setting the pressing position of the at least one of the pressing rollers.

9 Claims, 5 Drawing Figures

RECORDING MEMBER PRESSING DEVICE IN A PRINTER

BACKGROUND OF THE INVENTION

The present invention relates to a printer and, more particularly, to a recording member pressing device in a printer which automatically selects a suitable pressing position of each of paper pressing rollers according to the size of a recording member inserted.

FIG. 1 shows a perspective view of a conventional paper pressing system for a recording paper feed device in a printer. A platen 40 is rotated around an axis 41 (as indicated by a chain line) connected with a rotating mechanism. Under the platen 40, a plurality of paper feed rollers 43 are rotatably provided around an axis 42 (as indicated by a chain line) parallel with the axis 41 of the platen 40 and are in contact with a part of the circumference surface of the platen 40. A plurality of paper pressing rollers 45 positioned above the platen 40 are rotatably provided around an axis 44 (as indicated by a chain line) parallel with the axis 41 of the platen 40 and are slidably moved along the axis 44. The paper pressing rollers 45 can be detached from the surface of the platen 40 by operating a manual lever. Usually, the paper pressing rollers 45 press a recording paper around the platen 40 because the axis 44 of the paper pressing rollers 45 is stressed by a spring.

When the recording paper is inserted from the rear side and the upper side of the platen 40 and the platen 40 is rotated, the recording paper is forwarded to the under portion of the platen 40 along the platen 40 and is passed between the platen 40 and the paper feed rollers 43, and after that, the recording paper is guided to the front side and the upper side of the platen 40 to apply the recording paper to a printing position of the printer.

When the recording paper is reached at the printing position, the paper pressing rollers 45 press the recording paper on the platen 40. In this case, the pressing position in the vertical direction of each of the paper pressing rollers 45 is manually selected so that the paper pressing rollers 45 do not badly influence a printing operation of the printer.

In the printer having the above recording paper pressing system for a paper feed device, in case where different size recording papers are used in it for printing, the pressing position of each of the paper pressing rollers 45 must be manually changed by the operator every time the size of the recording paper is changed. The pressing positions of the paper pressing rollers 45 must be set on the right and the left sides of the recording paper outside a printing area of the recording paper. The manual operation may cause the missetting of or the nonselection of the pressing position of each of the pressing rollers when the different size recording papers are applied to the printer.

In particular, in an ink jet type printer in which ink droplets are jetted from a nozzle of a printing head on the printing position of the recording paper, if any paper pressing roller is set out of the recording paper, the size of the printed characters may be varied according to the recording paper condition. On the other hand, when some of the paper pressing rollers press the printing area of the recording paper, an ink jetted on the printed paper may be scattered by the rollers because the ink is not perfectly dried. Therefore, the printing quality may be remarkably reduced.

Recently, an automatic paper supply device has been used in the printer. However, if the different size recording papers are applied by the automatic paper supply device, the capability of the automatic paper supply device is remarkably decreased because the pressing positions of the paper pressing rollers of the paper pressing device must be manually selected by the operator.

SUMMARY OF THE INVENTION

Accordingly, it is an object of the present invention to provide a recording member pressing device for a printer which automatically selects a suitable position of each of sheet pressing rollers according to the size of the recording member and which enable a suitable printing operation with a high quality printing.

It is another object of the present invention to provide a paper pressing system for a paper feed device in a printer which accurately sets a recording paper to a printing position around a platen depending on the size of each of the recording papers.

It is a still another object of the present invention to provide a paper pressing device for a printer which sets a recording paper to a printing position around a platen by automatically and slidably moving paper pressing rollers depending on the size of each of the recording papers.

It is a further object of the present invention to provide a recording paper pressing deivce for a printer which automatically positions a recording paper to a printing position by cooperating with an automatic paper supplying device even when the diferrent size recording papers are applied to the printer.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To achieve the above object, in a printer including a platen rotatably provided around a first axis and a plurality of recording member pressing rollers rotatably provided around a second axis parallel with the first axis in which a recording member is forwarded to a printing position around the platen faced with a printing head and is pressed on the platen by the recording member pressing rollers, according to a preferred embodiment of the present invention, a recording member pressing device comprises, memory means for storing positioning information of at least one of the pressing rollers depending on the size of the recording member, recording member size detecting means for detecting the size of the inputted recording member, read-out means responsive to the recording member size detecting means for reading out the positioning information stored in said memory means, and positioning means responsive to the read-out means for slidably moving the at least one of the pressing rollers along the second axis and setting the pressing position of the at least one of the pressing rollers.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
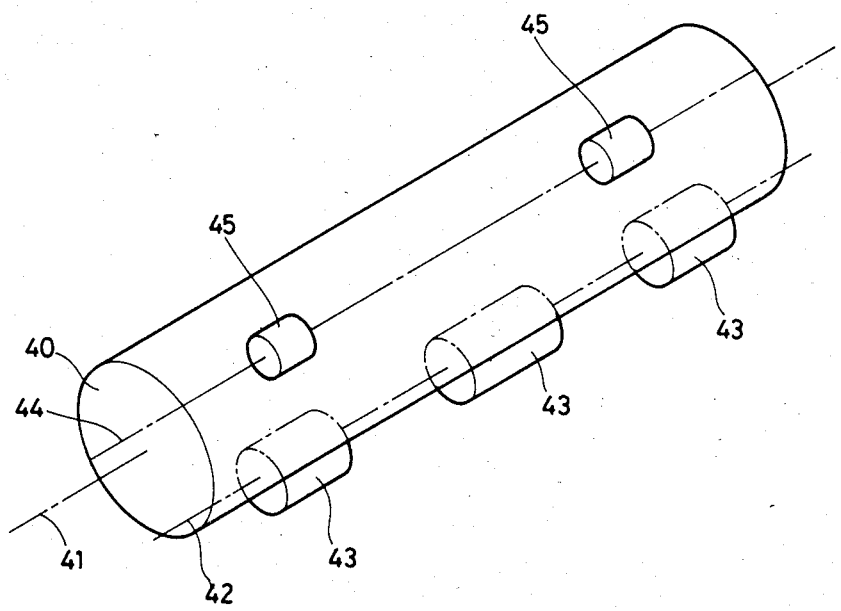
PRIOR ART FIG. 1
FIG. 1 shows a perspective view of a conventional paper pressing system for a recording paper feeding device in a printer.
Figure 2:
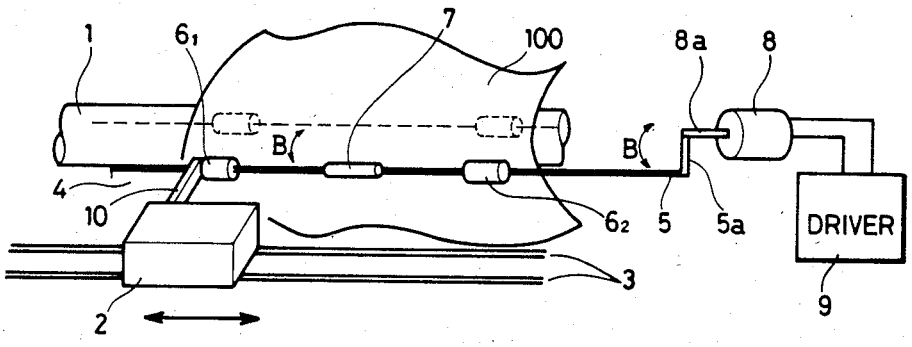
FIG. 2 shows a perspective view of a recording means of a printer including a paper pressing device according to a preferred embodiment of the present invention.

FIG. 2 shows a perspective view of a recording means of a printer including a recording paper pressing device according to a preferred embodiment of the present invention.

A platen 1 is rotated around an axis connected with a rotating mechanism. A carriage 2 carrying a printing head reciprocates along supporting axes 3 in the direction of the axis of the platen 1, and is faced with the platen 1. The platen 1 may be supported by a supporting axis. If the printer is a type of ink jet, the printing head may include a nozzle for jetting ink droplets. When printing, the ink droplets are jetted on the printing area of a recording paper 100 around the platen 1. Under the platen 1, a plurality of paper feed rollers are rotatably provided around an axis parallel with the axis of the platen 1, and are in contact with a part of the circumference surface of the platen 1.

According to a preferred embodiment of the present invention, a paper pressing device 4 comprises a plurality of recording paper pressing rollers 6 rotatably provided around an axis 5 parallel with the axis of the platen 1. The plurality of recording paper pressing rollers 6 are slidably moved along the axis 5. For example, two paper pressing rollers $6_1$ and $6_2$ are used in the paper pressing deivce 4. A separator 7 is provided with the axis 5 for separating the paper pressing rollers $6_1$ and $6_2$, while it is also rotated around the axis 5 and is slidably moved along the axis 5. The separator 7 having a predetermined length in the direction of the axis 5 is formed in a cylindrical shape. The diameter of the separator 7 is less than that of each of the paper pressing rollers $6_1$ and $6_2$. Usually, the paper pressing rollers $6_1$ and $6_2$ press the recording paper 100 around the platen 1 because the axis 5 of the paper pressing rollers $6_1$ and $6_2$ are stressed in the direction of the platen 1 by a spring. However, the paper pressing rollers $6_1$ and $6_2$ can be detached from the surface of the platen 1 by operating a manual lever.

One end portion of the axis 5 is bent to form an angle *5a*. The end of the angle *5a* is connected to a rotating axis *8a* of a rotary solenoid 8. The rotating direction of the rotary solenoid 8 is controlled by a driver 9. The rotary solenoid 8 is rotated by the driver 9 so that the axis 5 is moved between a first stabilizing position and a second stabilizing position against the platen 1 (as indicated by arrow B). In the first stabilizing position of the axis 5, the paper pressing rollers $6_1$ and $6_2$ with the axis 5 press the recording paper 100 around the platen 1. This condition is a paper pressing condition. In the second stabilizing position of the axis 5, the pressing position of each of the paper pressing rollers $6_1$ and $6_2$ is selected according to the change of the recording paper size. This condition is a pressing roller positioning condition.

An operating bar 10 is provided with the carriage 2 for slidably moving the paper pressing rollers $6_1$ and $6_2$ in the direction of the axis 5. The operating bar 10 projected from the carriage 2 to the platen 1 catches and pushes the paper pressing rollers $6_1$ and $6_2$ on the second stabilizing position so that the paper pressing rollers $6_1$ and $6_2$ can be slidably moved in the direction of the axis 5 to thereby select the correct pressing position of each of them at the area outside the printing area of the inserted recording paper depending on the size of the recording paper 100. The operating bar 10 is thus slidably moved with the carriage 2 along the platen 1.

When the recording paper 100 is inserted from the rear side and the upper side of the platen 1 as a paper supply portion and the platen 1 is rotated, the inserted recording paper 100 is forwarded to the under portion of the platen 1 along the platen 1 and is passed between the platen 1 and the paper feed rollers. Thereafter, the recording paper 100 is guided at the front side and the upper side of the platen 1 to set the recording paper 100 to a printing position faced with the printing head. The recording paper 100 passing through the printing position is pressed by the paper pressing rollers $6_1$ and $6_2$ for introducing it to a paper take out portion.

When the recording paper 100 is forwarded to the printing position around the platen 1 or is inserted from a paper supply portion of the printer, the size of the inserted recording paper 100 is detected by a conventional paper size detector. The paper size detector may comprise a photo-detector.

Figure 3:
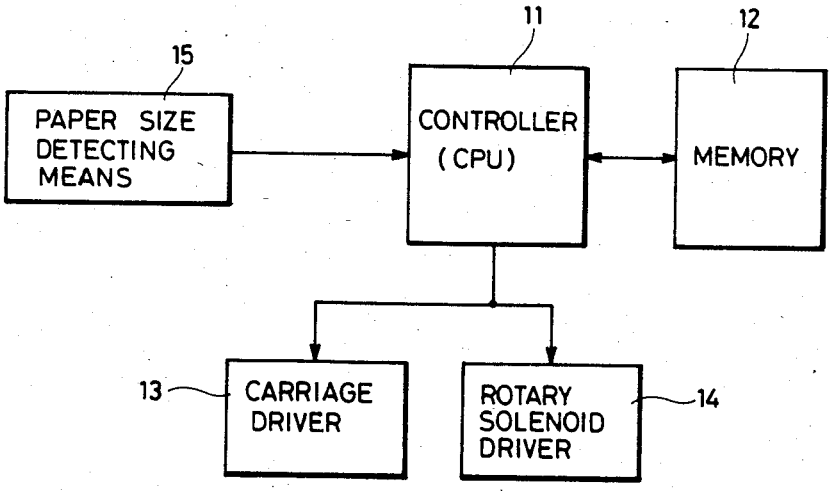
FIG. 3 shows a block diagram of a control circuit for automatically selecting the pressing position of each of the paper pressing rollers of FIG. 2 depending on the size of the inputted recording paper.

FIG. 3 shows a block diagram of a control circuit for automatically selecting the pressing position of each of the paper pressing rollers $6_1$ and $6_2$ depending on the size of the inputted recording paper 100. The control circuit comprises a controller such as a one-chip CPU (central processing unit) including an input/output interface and a memory for controlling a program, a memory 12 for storing positioning information relating to both right positions and left positions of the paper pressing rollers $6_1$ and $6_2$ corresponding to the various different size recording papers, a driver 13 responsive to the CPU 11 for driving a carriage 2 carrying the printing head, a driver 14 for driving the rotary solenoid 8, a paper size detecting means 14 for detecting the size of the inserted recording paper 100.

Figure 4A:
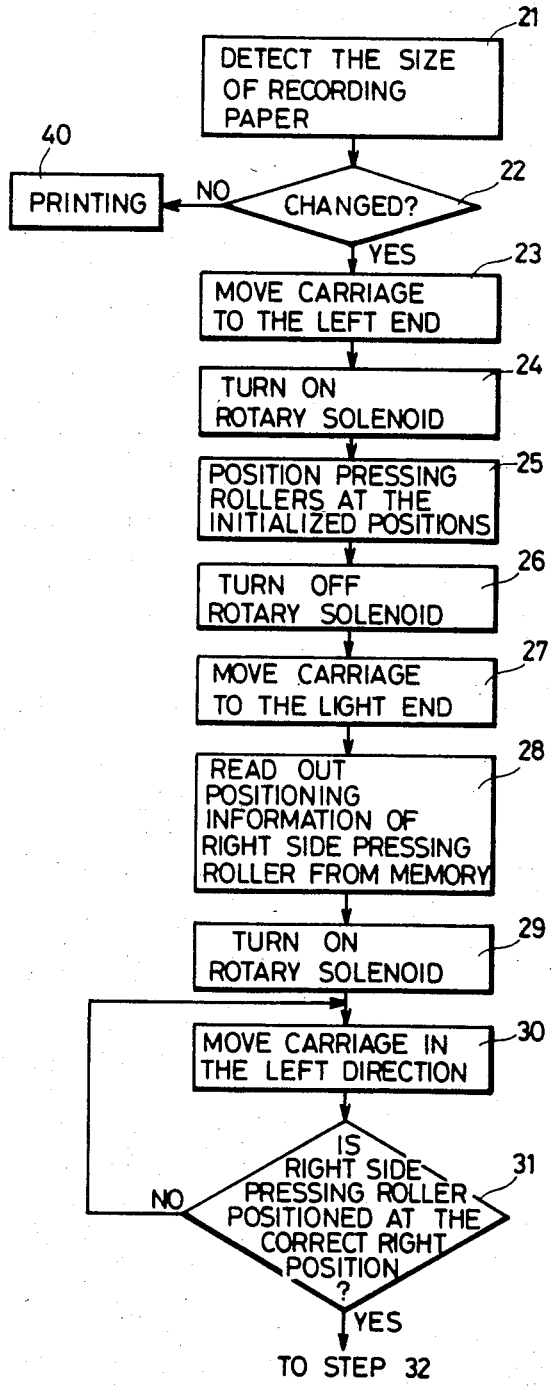
FIGS. 4(A) and 4(B) show flowcharts for explaining the operation of the paper pressing device according to the preferred embodiment of the present invention.
Figure 4B:
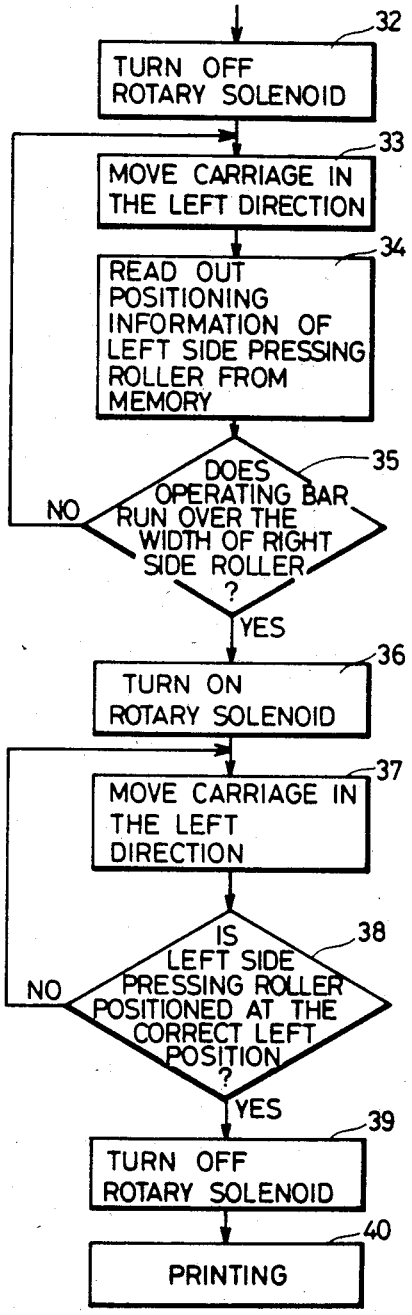

The operation of the paper pressing device according to the preferred embodiment of the present invention, as shown in FIGS. 2 and 3, will be described below with reference to flowcharts as shown in FIGS. 4(A) and 4(B).

When the recording paper 100 is inserted around the platen 1 from the paper inserting portion of the printer, the size of the inputted recording paper 100 is detected by the paper size detecting means 15 arranged around the paper inserting portion. The detecting signal from the paper detecting means 15 is applied to the CPU 11. The CPU 11 is operated to judge the size of the inputted recording paper in response to the applied detecting signal (Step 21). After detecting the paper size, the size of the presently inputted recording paper is compared with the size of the last inputted recording paper to detect whether the paper size is changed (Step 22).

If the size of the presently inputted paper and that of the last inputted paper are the same, the program is forwarded to Step 40 for executing a normal printing operation (Step 40).

On the other hand, when the size of the presently inputted recording paper 100 is different from the size of the last inputted recording paper, the carriage 2 is moved to a left end of the support axes 3 (Step 23). When the carriage 2 is reached at the left end, the rotary solenoid 8 turns ON by driving the driver 9 (14) (Step 24). When the rotary solenoid 8 is turned ON, the axis 5 with the paper pressing rollers $6_1$ and $6_2$ is lifted from the recording paper 100 by rotating it in the direction of the carriage 2 so that the axis 5 is positioned at the second stabilizing position in which the pressing positions of the paper pressing rollers $6_1$ and $6_2$ are decided. Following the lift-up movement of the axis 5, the carriage 2 with the operating bar 10 is slidably moved in the right direction, so that the paper pressing rollers $6_1$ and $6_2$ and the separator 7 are all positioned at initialized positions adjacent to the right end portion of the axis 5 (Step 25). In Step 25, when the carriage 2 is moved along the support axes 3 from the left end in the right direction, the tip of the operating bar 10 projected from the carriage 2 catches the paper pressing roller $6_1$ positioned at the left side, and the left side roller $6_1$ is slidably moved in the right direction with the operating bar 10 of the carriage 2. According to the further movement of the carriage 2 in the right direction, the separator 7 and the right side paper pressing roller $6_2$ are slidably moved in the right direction by the operating bar 10 with the left side paper pressing roller $6_1$.

The initialized positions of the paper pressing rollers $6_1$ and $6_2$ are set at the positions slightly separated from the end portion where the carriage 2 is stopped moving at the end of the supporting axes 3. Therefore, when the left and the right side paper pressing rollers $6_1$ and $6_2$ are reached at the predetermined initialized positions, the rotary solenoid 8 turns OFF (Step 26), and the axis 5 with the paper pressing rollers $6_1$ and $6_2$ and the separator 7 is rotated in the direction of the platen 1 so as to keep the paper pressing rollers $6_1$ and $6_2$ in contact with the platen 1. In this time, the carriage 2 is moved by the right end of the support axes 3 (Step 27).

After the rotary solenoid 8 turns OFF, the axis 5 is reached at the first stabilizing position. In this condition, the left side and the right side paper pressing rollers $6_1$ and $6_2$ are in a line via the separator 7, and the position of the operating bar 10 of the carriage 2 is positioned at the right side next to that of the right side paper pressing roller $6_2$.

First, the pressing position of the right side paper pressing roller $6_2$ is selected as follows. The positioning information relating to the pressing position of the right side paper pressing roller $6_2$ is readout from the memory 12 in response to the detecting signal of the paper size detecting means 15 (Step 28), and after, the rotary solenoid 8 turns ON (Step 29) so that the axis 5 is moved at the second stabilizing position.

As described above, after the paper pressing rollers $6_1$ and $6_2$ with the axis 5 is in the paper pressing roller positioning condition, the carriage 2 is slidably moved in the left direction (Step 30). According to the movement of the carriage 2, the operating bar 10 catches and pushes the right side paper pressing roller $6_2$ so that the left and the right side paper pressing rollers $6_1$ and $6_2$ and the separator 7 are all together moved in the left direction along the axis 5.

The movement of the carriage 2 in the left direction is carried out until the position of the right side paper pressing roller $6_2$ is equal to the right side pressing position readout from the memory 12 (Step 31).

When the light side paper pressing roller $6_2$ is reached at the position readout from the memory 12, the rotary solenoid 8 turns OFF (Step 32), and the axis 5 is moved down at the first stabilizing position so that the contact between the right side paper pressing roller $6_2$ and the operating bar 10 is released. The carriage 2 is, further, moved in the left direction (Step 33).

After the above operation, the positioning information relating to the pressing position of the left side paper pressing roller $6_1$ is readout from the memory 12 (Step 34), and step 35 is operated to judge whether the movement of distance of the carriage 2 is more than the width of the right side paper pressing roller $6_2$ after the operating bar 10 is released from the right side paper pressing roller $6_2$. The width information of the paper pressing rollers $6_1$ and $6_2$ may, previously, be stored in the memory. If the width information of the paper pressing rollers is stored in the memory, the above judgement is carried out in a such manner that the movement distance of the carriage 2 after releasing the operating bar 10 from the right side pressing roller $6_2$ is compared with the width of the paper pressing roller $6_2$.

When the carriage 2, namely, the operating bar 10 is moved by the width of the right side paper pressing roller $6_2$ in the left direction, the rotary solenoid 8 turns ON so as to set the pressing position of the left side paper pressing roller $6_1$ (Step 36), and the axis 5 with the paper pressing rollers $6_1$ and $6_2$ is lifted from the recording paper to position them to at the second stabilizing position. Following the movement of the axis 5, the carriage 2 is moved at the left side roller setting position as the positioning information readout from the memory in the left direction (Step 37).

According to the left movement of the carriage 2, the operating bar 10 catches and pushes the left side paper pressing roller $6_1$ so that the left side paper pressing roller $6_1$ is slidably moved in the left direction. When the left side paper pressing roller $6_1$ is reached at the pressing position readout from the memory (Step 38), the rotary solenoid 8 turns OFF (Step 39), and after that, the normal printing operation is caried out (Step 40).

When the rotary solenoid 8 turns OFF (Step 39), the axis 5 with the paper pressing rollers $6_1$ and $6_2$ is moved at the first stabilizing position. In this condition, the paper pressing rollers $6_1$ and $6_2$ are set at the paper pressing positions depending on the size of the inputted recording paper and press the recording paper around the platen 1 so as to maintain the suitable position of the recording paper when printing.

If a different size recording paper is inserted from the paper supply portion, an operating cycle including Steps 23–40 is repeatedly operated every time the size of the recording paper inputted is changed, and the paper pressing rollers $6_1$ and $6_2$ are automatically positioned at the paper pressing positions depending on the size of the inputted recording paper.

In the above embodiment, although the initialized positions of the paper pressing rollers $6_1$ and $6_2$ are at the right side of the axis 5 and its positioning operation is carried out with reference to the light side initialized positions, the initialized positions of the paper pressing rollers $6_1$ and $6_2$ may be set at everywhere of the axis 5, for example, at the middle portion or the left side portion of the axis 5.

The number of the paper pressing rollers may be more than two.

While the operating bar 10 is in the pressing roller positioning condition, the operating bar 10 can catch and push the paper pressing rollers $6_1$ and $6_2$, but cannot directly catch and push the separator 7. The separator 7 can be removed if the paper pressing rollers $6_1$ and $6_2$ are exactly separated by themselves when moving.

Although the operating bar 10 catches and pushes all of the paper pressing rollers 6, the operating bar 10 may catch and push at least one of the paper pressing rollers, while one of the other paper pressing rollers is set on a predetermined pressing position without moving in the direction of the axis.

As described above, in the preferred embodiment of the present invention, the pressing positions of the paper rollers are automatically selected depending on the size of the inserted recording paper. Therefore, it is unnecessary that the pressing positions of the paper pressing rollers are selected by manually sliding each of the paper pressing rollers every time the size of the recording paper is changed. Accordingly, the pressing position of each of the paper pressing rollers is accurately selected without the non-setting or missetting of the pressing position, and a mis-printing.

If the paper pressing device according to the present invention is used with the automatic recording paper supply device, the merit of the automatic paper supply device may be more raised.

The invention being thus described, it will be obvious that the same may be varied in many ways. Such variations are not to be regarded as a departure from the spirit and scope of the invention, and all such modifications are intended to be included within the scope of the following claims.

What is claimed is:

1. In a printer including a platen rotatably provided around a first axis and a plurality of recording member pressing rollers rotatably provided around a second axis parallel with the first axis in which a recording member is forwarded to a printing position around the platen faced with a printing head and is pressed on the platen by the recording member pressing rollers, said recording member pressing rollers being movable into and out of a recording member pressing position, a recording member pressing device comprising:

memory means for storing location information of at least one of the pressing rollers as a function of the size of the recording member;

recording member size detecting means for detecting the size of the recording member;

read-out means responsive to the recording member size detecting means for reading out the location information stored in said memory means; and locating means responsive to the read-out means for slidably moving the at least one of the pressing rollers along the second axis and setting the said pressing rollers into the said pressing position.

2. The recording member pressing device of claim 1, wherein the memory means is adapted to store a plurality of items of location information for the pressing rollers and the locating means is adapted to slidably move the pressing rollers.

3. The recording member pressing device of claim 1, said locating means comprising:

a carriage containing a bar means for catching and pushing at least one of the pressing rollers.

4. The recording member pressing device of claim 1, wherein the pressing rollers are slidably moved while they are out of the recording member pressing position.

5. The recording member pressing device of claim 1, said locating means comprising:

setting means for moving the second axis containing the pressing rollers into and out of said pressing position, wherein said setting means includes a rotary solenoid.

6. The recording member pressing device of claim 5, wherein an end portion of the second axis is bent to form an angle and is connected to the rotary solenoid.

7. The recording member pressing device of claim 1, further comprising:

supply means for automatically and successively supplying the recording member to the printer, wherein the supply means carries at least one recording member.

8. The recording member pressing device of claim 1, wherein the the printer is an ink jet printer.

9. A recording member pressing device system which contains a platen, paper pressing rollers and a recording member said paper pressing rollers being movable into and out of a pressing position with respect to said recording member, said system automatically selecting a suitable pressing location of each of said paper pressing rollers according to the size of the recording member, which comprises memory means for storing location information of at least one of the pressing rollers as a function of the size of the recording member;

recording member size detecting means for detecting the size of the recording member;

read-out means responsive to the recording member size detecting means for reading out the location information stored in said memory means; and locating means responsive to the read-out means for slidably moving at least one of the pressing rollers along said platen corresponding to the size of the recording member and setting the the pressing rollers into the said pressing position.

* * * * *